United States Patent [19]

Koga et al.

[11] 4,149,510

[45] Apr. 17, 1979

[54] RECOIL TYPE STARTER FOR INTERNAL-COMBUSTION ENGINE

[75] Inventors: Noritaka Koga, Sakado; Noriyasu Furuichi, Wako, both of Japan

[73] Assignee: Honda Giken Kogyo Kabushiki Kaisha, Tokyo, Japan

[21] Appl. No.: 812,354

[22] Filed: Jul. 5, 1977

[30] Foreign Application Priority Data

Sep. 7, 1976 [JP] Japan ..... 51-91909[U]

[51] Int. Cl.[2] ..... F02N 3/02

[52] U.S. Cl. ..... 123/185 BA; 123/185 A

[58] Field of Search ..... 123/185 A, 185 B, 185 BA

[56] References Cited

U.S. PATENT DOCUMENTS

| | | | |
|---|---|---|---|
| 2,460,420 | 2/1949 | Kincannon | 123/185 BA |
| 2,942,599 | 6/1960 | Irgens | 123/185 BA |
| 3,814,073 | 6/1974 | Nakatani | 123/185 A |
| 3,827,307 | 8/1974 | Couchman | 123/185 BA |
| 3,942,505 | 3/1976 | Tillotson | 123/185 BA |

*Primary Examiner*—Charles J. Myhre
*Assistant Examiner*—C. S. Miller
*Attorney, Agent, or Firm*—Polster, Polster and Lucchesi

[57] ABSTRACT

A recoil type starter device for an internal combustion engine is provided which includes a starting pulley fixed at one end of the engine crank shaft and having a plurality of openings in its circumferential side surface; and a rotatable rope pulley confronting the starting pulley and mounted on a separate fixed shaft, said rope pulley having a pawl to engage any of the openings of the starting pulley to transmit rotational force of the rope pulley to the starting pulley at the start of the engine, a spiral spring to take up the starting rope around the periphery of the rope pulley after start of the engine, a disc fixedly mounted on the shaft of the rope pulley, and a U-shaped wire spring, one end of which is connected to a spring fitting part on the pawl, and the other end of which is frictionally contacted around the circumference of the stationary disc. The spring normally biases the pawl to retracted position, but serves as a drag link to pull the pawl into erected position upon rotation of the rope pulley in a starting direction. A projected member is provided on the side surface of the rope pulley to contact with a tail of the wire spring wound around the stationary disc, when the pawl engages the starting pulley, to reduce the frictional contact force of the wire spring with respect to the stationary disc.

8 Claims, 3 Drawing Figures

RECOIL TYPE STARTER FOR INTERNAL-COMBUSTION ENGINE

BACKGROUND OF THE INVENTION

This invention relates to a starter device for an internal combustion engine, and, more particularly, it is concerned with a starter device of a recoil type for use in a small sized internal combustion gasoline engine mounted on a motor-cycle and the like.

This type of starter device for the internal combustion engine has been of such a construction that an engine starting rope or cord which is wound on a pulley by force of a spiral spring is vigorously pulled out so as to cause the rope pulley to perform a single turn, and the rotational force of this rope pulley is transmitted to a starting pulley through a forwarding pawl to thereby rotate the crank shaft of the engine fixedly secured on the rope pulley.

The abovementioned forwarding pawl becomes engaged with the starting pulley, only when the engine is started, and is automatically disengaged from the starting pulley after the engine starts so as to reinstate itself to its state prior to the engine start.

In the heretofore known starter device, since a cam plate or a ratchet mechanism or the like has been used for an engaging and disengaging mechanism with respect to the starter pulley for the abovementioned forwarding pawl, the construction of the device is complicated.

In view of the disadvantages inherent in the known type of the engine starter device, it is the primary object of the present invention to provide an improved starter device for an internal combustion engine which has successfully solved the abovementioned problems, is simple in construction, is adapted for industrial mass-production, is accurate in its operation, and is cheap in its manufacturing cost.

According to the present invention, generally stated, there is provided a recoil type starter device for an internal combustion engine which comprises: a casing; a starting pulley which is fixed at one end of an engine crank shaft within the casing, and has at least one opening in the circumferential side surface thereof; a rope pulley which is provided in confrontation to the starting pulley, and is supported in a rotatable manner on a separate fixed shaft within the casing; a forwarding pawl having a pawl portion at one end thereof to be engaged with the perforated opening of the abovementioned starting pulley and a spring fitting portion at the other end thereof, and which is oscillatably supported on a shaft in a on the side surface of the rope pulley to transmit the forward rotational force of the rope pulley in engagement with the opening of the starting pulley to start the engine; a spiral spring to take up the starting rope around the periphery of the rope pulley after start of the engine by reversely rotating the rope pulley; a stationary disc which is mounted on the supporting shaft of the abovementioned rope pulley; a wire spring part of which is in the shape of a letter "U", with two legs, an outer end of one of which is connected to the spring fitting part of the abovementioned forwarding pawl, and an extension of the end of the other of which frictionally embraces the circumference of the abovementioned stationary disc, being wound therearound in substantially a single turn, the wire spring having a force which tends to cause the two legs thereof to open outwardly to a position to cause the forwarding pawl normally to be retracted. The spring acts as a drag link between the forwarding pawl and the stationary disc when the rope pulley is rotated relative to the disc in a starting direction so as to erect the forwarding pawl. A stop is provided on the side surface of the rope pulley to limit the angle of erection of the abovementioned forwarding pawl and to cause the forwarding pawl to be engaged with the perforated opening of the starting pulley; and a projected member is provided on the side surface of the rope pulley to contact with a tail of the part of the wire spring frictionally contacted around the stationary disc, when the forwarding pawl becomes engaged with the starting pulley to reduce the frictional contact force of the wire spring with respect to the stationary disc.

There has thus been outlined rather broadly the more important features of the present invention in order that the detailed description thereof that follows may be better appreciated. There are, of course, additional features of the invention that will be described hereinafter. Those skilled in the art will appreciate that the conception, upon which this disclosure is based, may readily be utilized as a basis for the designing of other structures for carrying out the several purposes of the invention. It is important therefore that the claims be regarded as including such equivalent constructions to an extend that they do not depart from the spirit and scope of the invention.

BRIEF DESCRIPTION OF THE DRAWING

One specific embodiment of the present invention has been chosen for the purposes of illustration and description, and is shown in the accompanying drawings, forming a part of the specification, in which.

DETAILED DESCRIPTION OF PREFERRED EMBODIMENT

Figure 1:
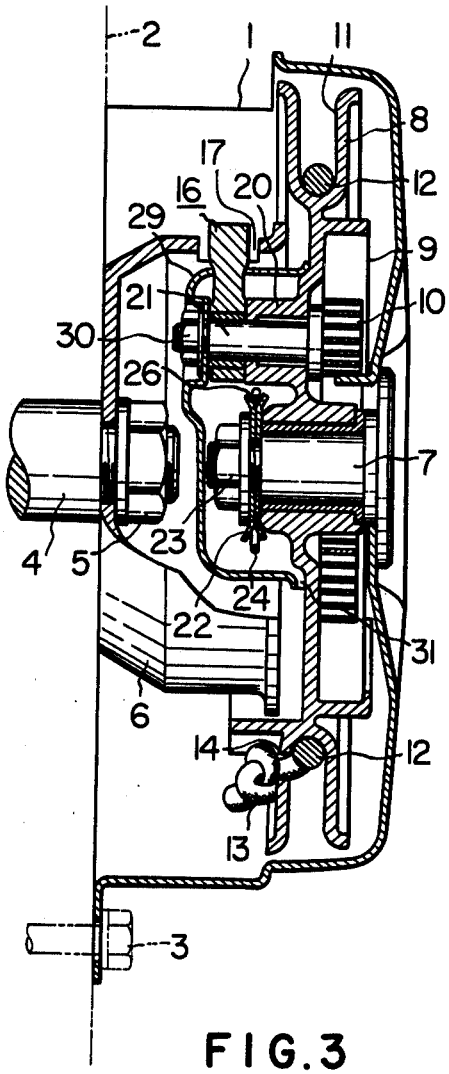
FIG. 1 is a side elevational view partly broken away and partly in longitudinal cross-section showing the recoil type engine starter device according to the present invention, wherein the forwarding pawl is shown to be engaged with the starting pulley.

In the following, a preferred embodiment of the recoil type starter device for the internal combustion engine according to the present invention will be described specifically in reference to the accompanying figures of the drawing.

Figure 2:
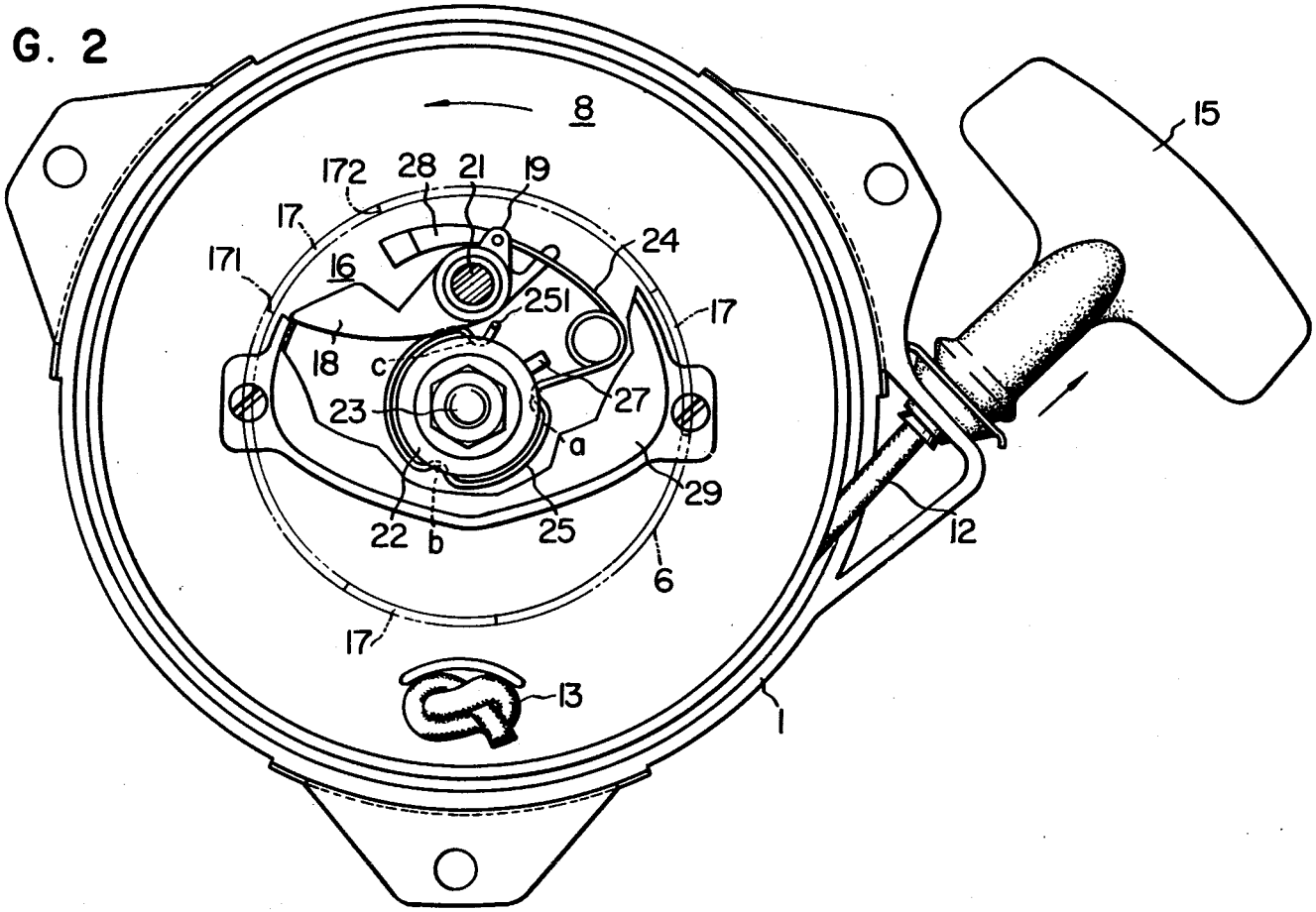
FIG. 2 is a plan view of the device shown in FIG. 1, with the forwarding pawl mechanism shown exposed as if the casing were open.

Referring to FIGS. 1 and 2, a casing 1 is mounted on an outer wall surface of a crank room 2 of an engine and fixed thereon with bolts 3. Within the abovementioned casing, there are accommodated a cup-shaped starting pulley 6, fixed on one end part of a crank shaft 4 with a bolt 5, and a rope pulley 8 rotatably supported on a fixed shaft 7 carried by the casing 1, in substantial axial alignment with the end of the crank shaft 4 and in confrontation to the starting pulley. There is also accommodated within the casing a spiral spring 10, one end of which is fixed on one part in a recessed portion 9 formed on the outside of the rope pulley, and the other end of which is fixed to the casing 1. The rope pulley 8 has on the outer peripheral surface thereof a deep channel 11 with a semi-circular bottom surface. A rope or cord 12 for starting the engine embraces the pulley within the channel 11. One end of this rope 12 passes through a hole 14 formed in one part of the rope pulley 8 and is knotted outside the through-hole, while the other end thereof passes out of the casing 1 and is fixed to an end part of a grip handle 15.

The gist of the present invention is concerned with an improvement in a clutch engagement and disengagement mechanism for the rope pulley 8 and the starting pulley 6 of the afore-described construction.

A forwarding pawl 16, which is one of various components to constitute the clutch engagement and disengagement mechanism according to the present invention, has a pawl part 18 and a spring fitting part 19 to be described later. The forwarding pawl 16 is so constructed that its pawl part 18 may be engaged with any one of three openings 17 formed in the cup-shaped periphery of the starting pulley 6 from its inside. The forwarding pawl 16 is rotatably supported on a fixed shaft 21, which is inserted into a boss 20 formed in one part of the rope pulley, and fixed there with a nut 30. A circular disc 22 is made up of a pair of annular washers each in the shape of a shallow dish with their bottom recessed portions being tightly fastened together by an appropriate expedient and fitted on the inward end of the supporting shaft 7 for the rope pulley, fixedly secured with a bolt 23. The outer edges of the washers are flared divergently in a radially outward direction, so as to define between them an annular groove or seat 26, as shown particularly in FIG. 1. A wire spring 24 has a U-shaped part at one end, with divergently biased legs, one of which has an outer end constituting one terminus of the spring 24, with a small loop formed between the legs at the middle, or bottom part of the U-shaped configuration. At its other end, the spring 24 has a seat-embracing end part 25. The terminal end of the one leg is hooked in a hole in the spring fitting part 19 of the abovementioned forwarding pawl, while the other end 25 of the wire spring 24 is fitted in and around the V-shaped groove 26 in a substantially single turn. The spring 24 is made so as to impart a force which tends to open the opposing two legs of the U-shaped part outwardly so as to cause the pawl part 18 of the forwarding pawl 16 to escape, or to be released, from any one of the openings 17, with which it is engaged. The end part 25 of the wire spring 24 is formed in a ring shape, with inwardly protruding portions a, b, and c formed at substantially equally spaced intervals so that there may be produced elastic frictional contact between the inwardly protruded portions a, b, and c and the V-shaped groove 26 of the circular disc 22, when the ring portion is fitted therein. The spring 24 terminates at the end part 25, in an outwardly projecting tail 251.

The frictional contact force should be of such a magnitude that the ring-shaped portion 25 of the wire spring 24 is intimately contacted to the V-shaped groove 26 of the circular disc 22 until the forwarding pawl 16 is stood upright by relative movement of the wire spring 24 and the rope pulley at the time of its rotation, as will be described later.

The angle of opening between the abovementioned protrusions a and c of the ring-shaped portion of the wire spring 24 should preferably be from 45 to 80 degrees with the axis of the supporting shaft 7 as the center in to facilitate disengagement of this ring-shaped portion from the circular disc 22 and the frictional contact thereof with the V-shaped groove 26 of the circular disc 22, as will be explained.

There is integrally formed on the side surface of the rope pulley 8 a projected part 27 which collides with the tail 251 of the ring-shaped portion of the wire spring 24 to reduce the frictional contact force thereof with respect to the circular disc 22 at the time of rotation of the rope pulley, and a stop 28 for restricting any further movement of the forwarding pawl 16 when it retracts inwardly of the cup-shaped starting pulley 6.

Reference numeral 29 designates a dust protection cover for the forwarding pawl 16, the circular disc 22, wire spring 24, and so on, and is also fixed with the nut 30 on the inner end part of the supporting shaft 21 for the forwarding pawl 16. This dust cover also has a water draining port 31 at the lower portion thereof.

In the following, the operations of the recoil type starter for the internal combustion engine according to the present invention will be stated.

FIG. 2 shows a state prior to start of the engine, in which the forwarding pawl 16 is released from the starting pulley 6, and the spring fitting part 19 thereof is in contact with the one end of the stop 28.

Figure 3:
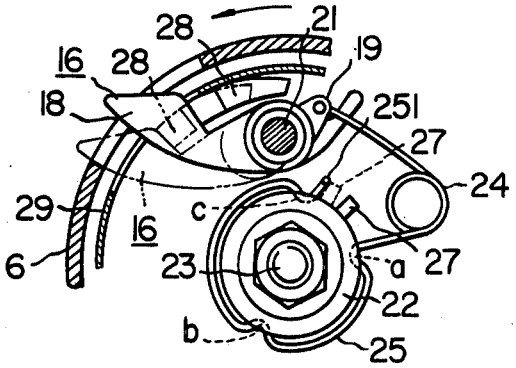
FIG. 3 is a fragmentary sectional view showing a main part of the recoiling mechanism for the operation of the forwarding pawl.

At the time of the engine start, when an operator holds the grip 15 and pulls the cord 12 in the direction of an arrow mark, the rope pulley 8 rotates in the counter-clockwise direction, and, at the same time, the forwarding pawl 16 and its supporting shaft 21 rotate in the same direction, and the spiral spring 10 begins to wind up. At this time, the wire spring 24 is urged to rotate by being pulled by the forwarding pawl 16, although it is inhibited from rotation due to the frictional contact force between the ring-shaped portion of the wire spring 24 and the disc 22. On account of this, the forwarding pawl 16 is pulled by the wire spring 24, which acts as a drag link between the forwarding pawl and the disc 22, as shown by the solid line in FIG. 3 and its pawl portion 18 oscillates outwardly (or is erected) to plunge into any one of the three openings 17 formed in the peripheral side surface of the starting pulley 6, and collides with an end surface of the stop 28. By the subsequent rotation of the rope pulley 8, the pawl portion 18 is held between one edge 171 of the opening 17 of the starting pulley 6 and the stop 28 as shown by a chain line in FIG. 3, and is maintained in an engaged state with the starting pulley 6. At the same time, the projection 27 of the rope pulley 8 collides with the tail 251 of the ring-shaped portion of the wire spring 24 frictionally contacted around the disc 22, on account of which the ring-shaped portion thereof around the disc 22 is pushed open outwardly, whereby the frictional contact force between the ring-shaped portion 25 of the wire spring 24 and the disc 22 is reduced, and the wire spring 24 rotates together with the rope pulley 8. In this state, the rotational force of the rope pulley 8 is transmitted to the starting pulley 6 through the forwarding pawl 16 and acts to rotate the crank shaft 4, thereby starting the engine.

When the engine starts, the starting pulley 6 is also rotated by the crank shaft 4 with the result that the other edge 172 of the opening 17 of the starting pulley 6 comes into contact with the forwarding pawl 16 returning, the forwarding pawl 16 to its original state as shown in FIG. 2, and, at the same time, the wire spring 24 also returns to the original state by being pulled by the forwarding pawl 16. In this case, the projection 27 of the rope pulley 8 is in contact with the tail 251 of the ring-shaped portion 25 of the wire spring 24 frictionally contacted around the disc 22, and the frictional contact force of this ring-shaped portion 25 with respect to the disc 22, on which it is fitted, is in a reduced state, so that the wire spring 24 can easily return to its original state.

When the grip 15 in the hand of the vehicle rider is released, the rope pulley 8 rotates in the clockwise direction due to returning force of the spiral spring 10 to thereby wind up the rope 12 around the rope pulley 8. At the same time, the forwarding pawl 16 also rotates in the same direction, whereby the inwardly protruded portions a and b on the ring-shaped portion 25 tend to separate from the disc 22, whereby the circumferentially fitted ring-shaped portion 25 of the wire spring 24 reduces its frictional contact force with respect to the disc 22. Accordingly, the ring-shaped portion 25 slips on the outer peripheral surface of the disc 22, i.e., along the V-shaped groove 26, and the wind-up operation of the abovementioned rope 12 is smoothly carried out.

As stated in the foregoing, the present invention is capable of engaging a single forwarding pawl 16 with the starting pulley 6 without failure, by the action of the stop 28 and the projection 27 integrally formed on the rope pulley 8, and of transmitting the rotational force of the rope pulley 8 to the starting pulley 6. Furthermore, the aforedescribed erecting mechanism for the forwarding pawl 16 is positioned within the starting pulley 6, so that its construction is simple and compact with reduced number of the component parts with the consequence that the assembly thereof is easy which contributes to the industrialized mass production at a cheaper cost.

Although the present invention has been described in the foregoing with particular reference to a preferred embodiment thereof, it should be understood that the embodiment is merely illustrative and not restrictive, and that any changes and modifications may be made by persons skilled in the art within the spirit and scope of the present invention as set forth in the appended claims.

What is claimed is:

1. A recoil type starter for an internal combustion engine which comprises in combination:

(a) a casing;

(b) a starting pulley which is fixed at one end of an engine crank shaft within said casing, and has at least one opening in the peripheral side surface thereof;

(c) a rope pulley which is provided in confrontation to said starting pulley and is rotatably supported on a shaft within and fixedly carried by said casing;

(d) a forwarding pawl having a pawl portion at one end thereof to be engaged with the opening of said starting pulley and a spring fitting portion at the other end thereof, and which is supported on the shaft in a manner oscillatable on the side surface of said rope pulley to transmit the forward rotational force of said rope pulley to said starting pulley in engagement with the opening thereof at the start of the engine;

(e) a spiral spring to take up a starting rope around the periphery of the rope pulley after start of the engine by reversely rotating the rope pulley;

(f) a stationary disc having a groove on the circumference thereof, and which is mounted on the said supporting shaft of said rope pulley;

(g) a wire spring having a part in the shape of a letter "U," one end of a leg of which is connected to the spring fitting part of said forwarding pawl, and the end of the other leg of which is extended to form a ring-shaped section which is frictionally contacted around the circumference of said stationary disc in a substantially single turn, terminating in a tail, said wire spring having a force which tends to cause the opposing two legs of the U-shaped part thereof to open outwardly to a position to cause the forwarding pawl normally to be retracted, said spring acting as a drag link between said forwarding pawl and said disc when said rope pulley is rotated relative to said disc in a starting direction to cause said forwarding pawl to be erected with rotation of said rope pulley;

(h) a stop which is fixedly provided on the side surface of said rope pulley to limit the angle of erection of said forwarding pawl and to cause said forwarding pawl to be engaged with the opening of said starting pulley; and (i) a projected member which is provided on the side surface of said rope pulley to contact with the tail of said wire spring frictionally contacted around said stationary disc, when said forwarding pawl becomes engaged with the starting pulley to reduce the frictional contact force of said wire spring with respect to said stationary disc.

2. The recoil type starting device for an internal combustion engine as set forth in claim 1, in which a plurality of inwardly protruding portions are formed on one of the legs of said wire spring, which is formed in a ring shape and is substantially in a wound state around the circumferential groove of said disc so as to secure frictional contact between said ring portion of said wire spring and the outer peripheral surface of said circular disc.

3. The recoil type starter device for an internal combustion engine as set forth in claim 1, in which a protective cover is mounted on said rope pulley in a detachably attachable manner to protect said forwarding pawl, wire spring, and circular disc from dust and other contaminants.

4. The recoil type starter device for an internal combustion engine as set forth in claim 1, in which said circular disc is constructed with a pair of dish-shaped circular washers by intimately fastening the recessed bottom parts thereof so as to form a V-shaped groove around the circumference thereof so as to permit the ring-shaped portion of said wire spring to be fitted therein in the form of its being wound therearound in substantially a single turn.

5. In a recoil type starter device for an internal combustion engine comprising a casing, a starting pulley which is fixed at one end of an engine crank shaft within said casing and has at least one opening in the peripheral side surface thereof, a rope pulley which is provided in confrontation to said starting pulley, and is rotatably supported on a shaft within said casing, a forwarding pawl which is provided on one part of said rope pulley in an oscillatable manner to transmit the forward rotational force of said rope pulley to said starting pulley in engagement with the opening thereof at the start of the engine, and a spiral spring to take up the starting rope around the periphery of the rope pulley after start of the engine by reversely rotating the rope pulley, the improvement which comprises:

a stationary disc having a groove on the circumference thereof, and which is mounted on a fixed supporting shaft of said rope pulley;

a wire spring a part of which is in the shape of a letter "U," one end of which is fixed to a spring fitting part on said forwarding pawl, and the other end of which is frictionally contacted around the circumference of said stationary disc in a substantially single turn, said wire spring having a force which tends to cause the opposing two legs thereof to open outwardly so as to cause the forwarding pawl normally to be retracted, said spring acting as a drag link between said forwarding pawl and said disc when said rope pulley is rotated relative to said disc in a starting direction to cause said forwarding pawl to be erected with rotation of said rope pulley;

a stop which is fixedly provided on the side surface of said rope pulley to limit the angle of erection of said forwarding pawl and to cause said forwarding pawl to be engaged with the opening of said starting pulley; and a projected member which is provided on the side surface of said rope pulley to contact with the tip end part of said wire spring frictionally contacted around the stationary disc, when said forwarding pawl becomes engaged with the starting pulley, to reduce the frictional contact force of said wire spring with respect to said stationary disc, said forwarding pawl having a pawl portion at one end thereof to be engaged with the perforated opening of said starting pulley and a spring fitting portion at the other end thereof, and being supported on the shaft in a manner oscillatable on the side surface of said rope pulley.

6. The recoil type starting device for an internal combustion engine as set forth in claim 5, in which a plurality of inwardly protruding portions are formed on one of the legs of said wire spring, which is formed in a ring shape and is substantially in a wound state around the circumferential groove of said disc so as to secure frictional contact between said ring portion of said wire spring and the outer peripheral surface of said circular disc.

7. The recoil type starter device for an internal combustion engine as set forth in claim 5, in which a protective cover is mounted on said rope pulley in a detachably attachable manner to protect said forwarding pawl, wire spring, and circular disc from dust and other contaminants.

8. The recoil type starter device for an internal combustion engine as set forth in claim 5, in which said circular disc is constructed with a pair of dish-shaped circular washers by intimately fastening the recessed bottom parts thereof so as to form a V-shaped groove around the circumference thereof so as to permit the ring-shaped portion of said wire spring to be fitted therein in the form of its being wound therearound in substantially a single turn.

* * * * *